US008136636B2

(12) United States Patent
Bahjat et al.

(10) Patent No.: US 8,136,636 B2
(45) Date of Patent: Mar. 20, 2012

(54) ELEVATOR HALL CALL SYSTEM INCLUDING A PROGRAMMABLE ADAPTABLE TOUCH SCREEN

(75) Inventors: Zuhair Bahjat, Farmington, CT (US); Frank Sansevero, Glastonbury, CT (US); Harry Terry, Avon, CT (US); Richard Pulling, Avon, CT (US); Daniel Stillion, Woodside, CA (US); Kate Schreiber, Cambridge, MA (US); Gregg Draudt, Stow, MA (US); Jared A. Judson, Topsfield, MA (US)

(73) Assignee: Otis Elevator Company, Farmington, CT (US)

( * ) Notice: Subject to any disclaimer, the term of this patent is extended or adjusted under 35 U.S.C. 154(b) by 812 days.

(21) Appl. No.: 11/628,102

(22) PCT Filed: Jun. 29, 2004

(86) PCT No.: PCT/US2004/020950

§ 371 (c)(1),
(2), (4) Date: Apr. 7, 2009

(87) PCT Pub. No.: WO2006/011876

PCT Pub. Date: Feb. 2, 2006

(65) Prior Publication Data

US 2009/0294221 A1 Dec. 3, 2009

(51) Int. Cl.
*B66B 1/34* (2006.01)

(52) U.S. Cl. ..... 187/391; 187/396

(58) Field of Classification Search ..... 187/247, 187/380–388, 391–393, 396

See application file for complete search history.

(56) References Cited

U.S. PATENT DOCUMENTS

| | | | | |
|---|---|---|---|---|
| 5,679,934 | A * | 10/1997 | Juntunen et al. | 187/395 |
| 5,689,094 | A | 11/1997 | Friedli et al. | |
| 5,932,853 | A | 8/1999 | Friedli et al. | |
| 6,202,799 | B1 * | 3/2001 | Drop | 187/388 |
| 6,315,083 | B1 | 11/2001 | Schuster et al. | |
| 6,502,668 | B1 * | 1/2003 | Chida et al. | 187/395 |
| 6,550,587 | B1 * | 4/2003 | Yuasa et al. | 187/394 |
| 6,615,175 | B1 | 9/2003 | Gazdzinski | |
| 7,353,915 | B2 * | 4/2008 | Zaharia et al. | 187/388 |

(Continued)

FOREIGN PATENT DOCUMENTS

FR 2797858 A1 3/2001

(Continued)

OTHER PUBLICATIONS

PCT International Search Report for PCT/US2004/020950, dated Mar. 2, 2005.

(Continued)

*Primary Examiner* — Anthony Salata
(74) *Attorney, Agent, or Firm* — Carlson, Gaskey & Olds PC

(57) ABSTRACT

Elevator hall call devices have a programmable touch screen which can be programmed to display (a) ten-key destination call buttons, (b) up hall call and down hall call buttons, or (c) N-key destination buttons, as well as buttons which identify utilization of major floors of the building, including functions such as cafeteria, sky lobby, parking, public transport, and lobby, as well as tenants. A controller programs the touch screen in dependence on (d) traffic volume, (e) time of day, (f) floor of the building where the touch screen is disposed or (g) identity of a particular passenger (VIP) in the vicinity of a touch screen.

5 Claims, 4 Drawing Sheets

U.S. PATENT DOCUMENTS

| | | | | |
|---|---|---|---|---|
| 7,377,364 | B2 * | 5/2008 | Tyni et al. | 187/380 |
| 7,445,090 | B2 * | 11/2008 | Bodmer et al. | 187/391 |
| 7,559,408 | B2 * | 7/2009 | Flynn et al. | 187/396 |
| 7,711,565 | B1 * | 5/2010 | Gazdzinski | 704/270 |
| 7,766,129 | B2 * | 8/2010 | Makela et al. | 187/396 |
| 2001/0035314 | A1 * | 11/2001 | Yoshida et al. | 187/382 |
| 2002/0063632 | A1 | 5/2002 | Bowman et al. | |
| 2002/0112922 | A1 | 8/2002 | Smith | |
| 2002/0191029 | A1 | 12/2002 | Gillespie et al. | |
| 2003/0192746 | A1 | 10/2003 | Suzuki | |
| 2004/0262093 | A1 | 12/2004 | Forsythe et al. | |

FOREIGN PATENT DOCUMENTS

| | | | |
|---|---|---|---|
| GB | 2241090 | A | 8/1991 |
| GB | 2241090 | B | 2/1994 |
| JP | 62215481 | | 9/1987 |
| JP | 10194618 | | 7/1998 |
| JP | 11139704 | | 5/1999 |

OTHER PUBLICATIONS

PCT Written Opinion for PCT/US2004/020950, dated Mar. 2, 2005.

PCT International Preliminary Examination Report for PCT/US2004/020950, dated Jun. 28, 2005.

Supplementary European Search Report for Application No. EP 04 75 6398 dated Nov. 3, 2011.

First Office Action issued by Patent Office of the People's Republic of China on Jun. 6, 2008, for the corresponding Chinese Patent Application No. 200480043431.0.

* cited by examiner

FIG.2
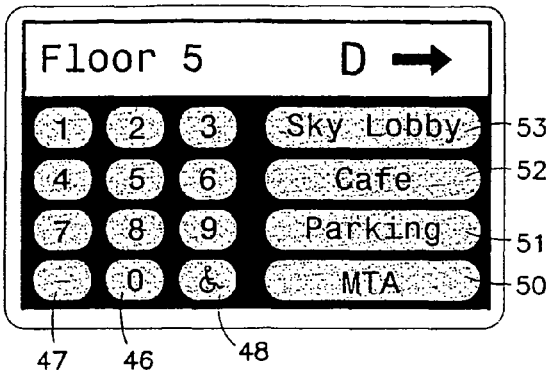
FIG.3
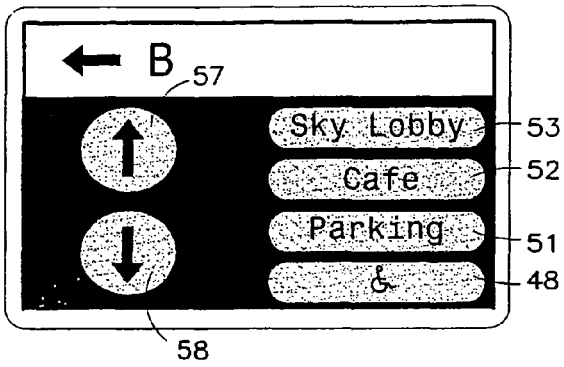
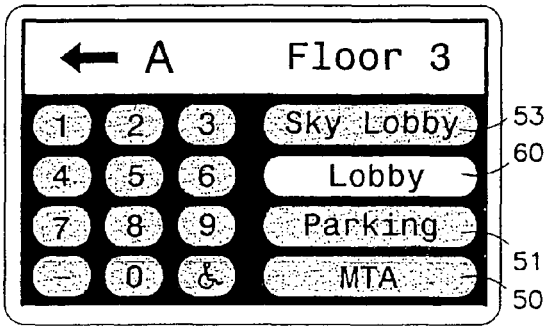
FIG.4
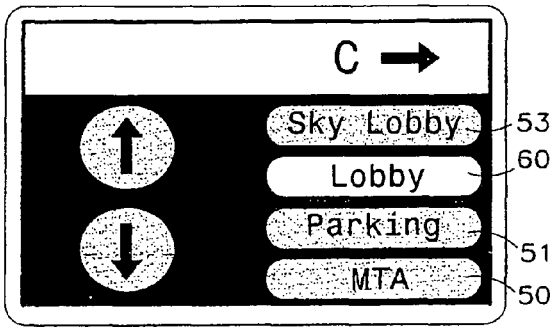
FIG.5
FIG.6
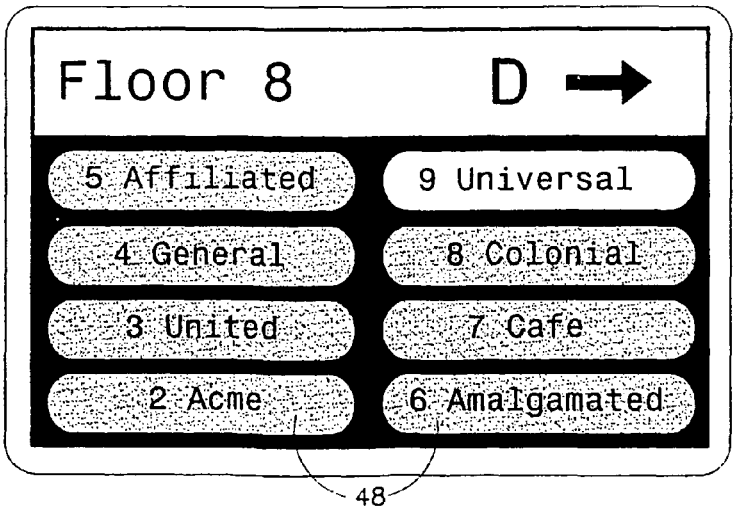

ELEVATOR HALL CALL SYSTEM INCLUDING A PROGRAMMABLE ADAPTABLE TOUCH SCREEN

TECHNICAL FIELD

This invention relates to elevator call devices having a touch screen which is adapted to display and respond differently (a) during different times of day, (b) during different elevator traffic modes, (c) at different floors, and (d) to certain passengers.

BACKGROUND OF THE INVENTION

A wide variety of techniques for interfacing passengers with elevators are known in the art. One class of devices call an elevator to a floor to pick up a passenger, which may be as simple as the well-known up/down call buttons. More recent call destination systems might display many numbered floor buttons, or might consist of ten-key destination floor call devices. Entering a destination floor into a multi-keyed call device requires a moment of concentration and some care. Still other devices include card readers as well as hand-held call devices and smart badges which operate in a wireless fashion, such as using electromagnetic radiation (RF, IR), to indicate the desire to be picked up on a certain floor, the desired destination floor, and possibly the security access for the destination floor.

To inform passengers which elevators will serve them, the technique might be as simple as up/down directional lanterns which light as an elevator approaches a floor, or which light immediately (or fairly soon) after a call is placed. For remote call devices and certain of the destination call devices, an indication may appear on the device itself, such indication comprising a symbol indicative of the elevator which will respond to that call.

During morning rush hour, up peak elevator traffic may be handled without any call devices. In the simplest of techniques, passengers simply walk in and observe on a panel adjacent each elevator the floor numbers of the group of floors being served by any particular elevator which is, or is about to be, standing at the landing. This is sometimes referred to as "channeling", as is disclosed in U.S. Pat. No. 4,804,069 entitled "Contiguous Floor Channeling Elevator Dispatching" and U.S. Pat. No. 4,846,311, entitled "Optimized 'Up-Peak' Elevator Channeling System with Predicted Traffic Volume Equalized Sector Assignments". Assigning sectors to different elevators is one of the ways that traffic flow is increased. This of course makes it more difficult for passengers to determine which elevator to take.

In systems having destination call panels, it has been known to provide, typically by means of a letter, the indication of the elevator which is to serve a group of floors including the floor of the destination which has just been entered on the call device. However, the use of the destination call device itself slows down the flow of rush hour traffic.

DISCLOSURE OF INVENTION

Objects of the invention include: improvements in handling elevator traffic: improved passenger use of elevators; elevator call devices which are adapted to suit the different times of day, different traffic modes, different floors, and different passengers; and elevator call devices which are well suited, at different times of day, to serve various passengers during various traffic modes.

This invention is predicated on our discovery that passenger perception of difficulty or unpleasantness in interfacing with elevators is dependent on the passenger's perception of the need for, or benefit to the passenger of, the steps which the passenger must take to call an elevator and enter the passenger's destination.

According to the present invention, programmable adaptable passenger interface devices, for registering destination calls and for providing information, such as the identity of and direction toward the elevator which will handle the call, have the presentation and concomitant response changed to suit different traffic modes or times of day, different floors of a building, and specific passengers. According further to the invention, a multi-key destination call entry device has in addition to the numbered keys, dedicated keys indicative of major service floors, such as lobby, cafeteria, sky lobby, parking, and public transport, and/or major tenants.

The invention may be practiced in call devices embodied in hand-held devices, on kiosks, and wall panels.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 2 is a plan view of a programmable passenger interface of the invention programmed for the lobby floor during heavy traffic.

FIG. 3 is a plan view of a programmable passenger interface of the invention programmed for the lobby floor during light traffic.

FIG. 4 is a plan view of a programmable passenger interface of the invention programmed for the cafeteria floor during heavy traffic.

FIG. 5 is a plan view of a programmable passenger interface of the invention programmed for the cafeteria floor during light traffic.

FIG. 6 is a plan view of a programmable passenger interface of the invention programmed for the lobby floor during morning up peak in which channeling is employed, showing only the floors of the sector to which car D is assigned.

MODE(S) FOR CARRYING OUT THE INVENTION

Figure 1:
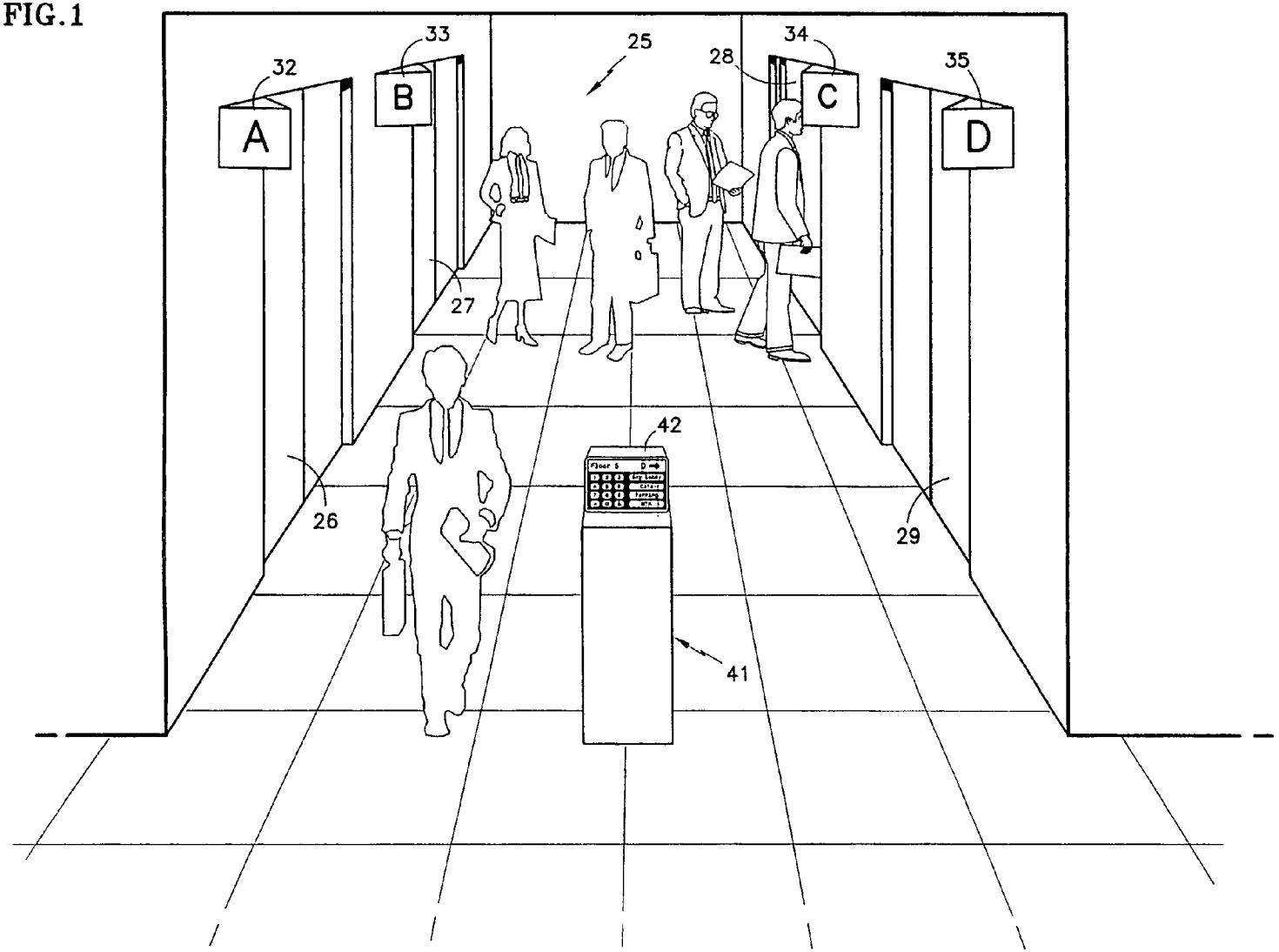
FIG. 1 is a simplified perspective view of an elevator lobby having a kiosk having a programmable adaptable touch screen in accordance with the invention, shown more clearly in detail in FIGS. 2-7, and 9.

In FIG. 1, an elevator lobby 25 includes a plurality of elevators 26-29, each having an elevator indicator 32-35 disposed adjacent thereto which is capable of illuminating to indicate the presence, or impending presence, of the related elevator. A kiosk 41 includes a programmable adaptable touch screen 42 of the invention, the nature of which is described more fully with respect to FIGS. 2-7 and 9.

In FIG. 2, one programmable display that is programmed for the lobby during heavy traffic includes a ten-key pad 46, a reset button 47 and a handicapped call indicating button 48. The display also includes floor utilization buttons 50-53 which identify either a floor function or a major tenant of the floor; these buttons allow selecting public transportation 50, a parking level 51, a cafeteria 52 or a sky lobby 53. The display of FIG. 2 also identifies the floor, 5, which the passenger has selected, identifies the elevator, D, which will respond to the call and points to the right to indicate where elevator D is.

The same display at the lobby during periods of low traffic may be programmed as illustrated in FIG. 3. Instead of the ten-key pad 46, the display presents only the conventional up and down hall call buttons 57, 58. Since no floor is designated when the up and down buttons are utilized, no floor is displayed. However, if any one of the specific floor buttons 51-53 is pressed, that may result in a display (not shown). The specific location of some buttons will be programmable and will vary and some buttons will have fixed locations.

FIGS. 4 and 5 illustrate how the touch screens of FIGS. 2 and 3 may be modified for use on the café floor, wherein the specific floor buttons 50, 51, 53 remain the same, but the café button 52 is eliminated in favor of a lobby button 60. As illustrated in FIGS. 4 and 5, one of the floor utilization buttons will change color when it is lit, as illustrated by the LOBBY button. In all other respects, the touch screens of FIGS. 4 and 5 are identical to those of FIGS. 2 and 3.

FIG. 6 illustrates a programmable, adaptable touch screen programmed for use when an elevator is assigned to serve contiguous floors. Therein, specific, numbered floors are set out, with adjacent panels which may light up to indicate a call registered to the floor. As programmed for up peak in FIG. 6, the touch screen presents combined buttons including both floor numbers and floor utilization, such as major tenants and the café.

Although FIG. 6 has been described as representing a programmed touch screen which may find value during up peak, it obviously also represents an N-key configuration which may be utilized in a building with only nine floors.

Figure 7:
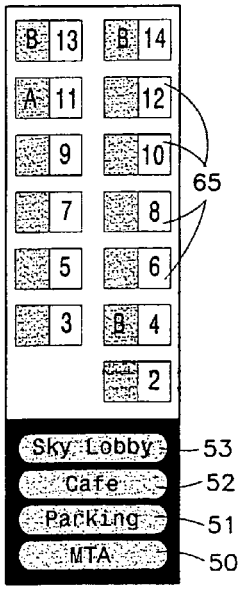
FIG. 7 is a plan view of a programmable passenger interface of the invention programmed as an N-key call entry device with major service floor buttons, for use at the lobby during heavy traffic.

The programmable adaptable touch screens described thus far with respect to FIGS. 2-5 convert from ten-key panel and floor utilization buttons, with display, to conventional up/down call buttons, with floor utilization buttons and display. However, as illustrated in FIG. 7, instead of ten-key panels, the touch screens of the invention may be configured for N-key panels, having a button 65 for each floor which can be selected, as well as floor utilization buttons.

Figure 8:
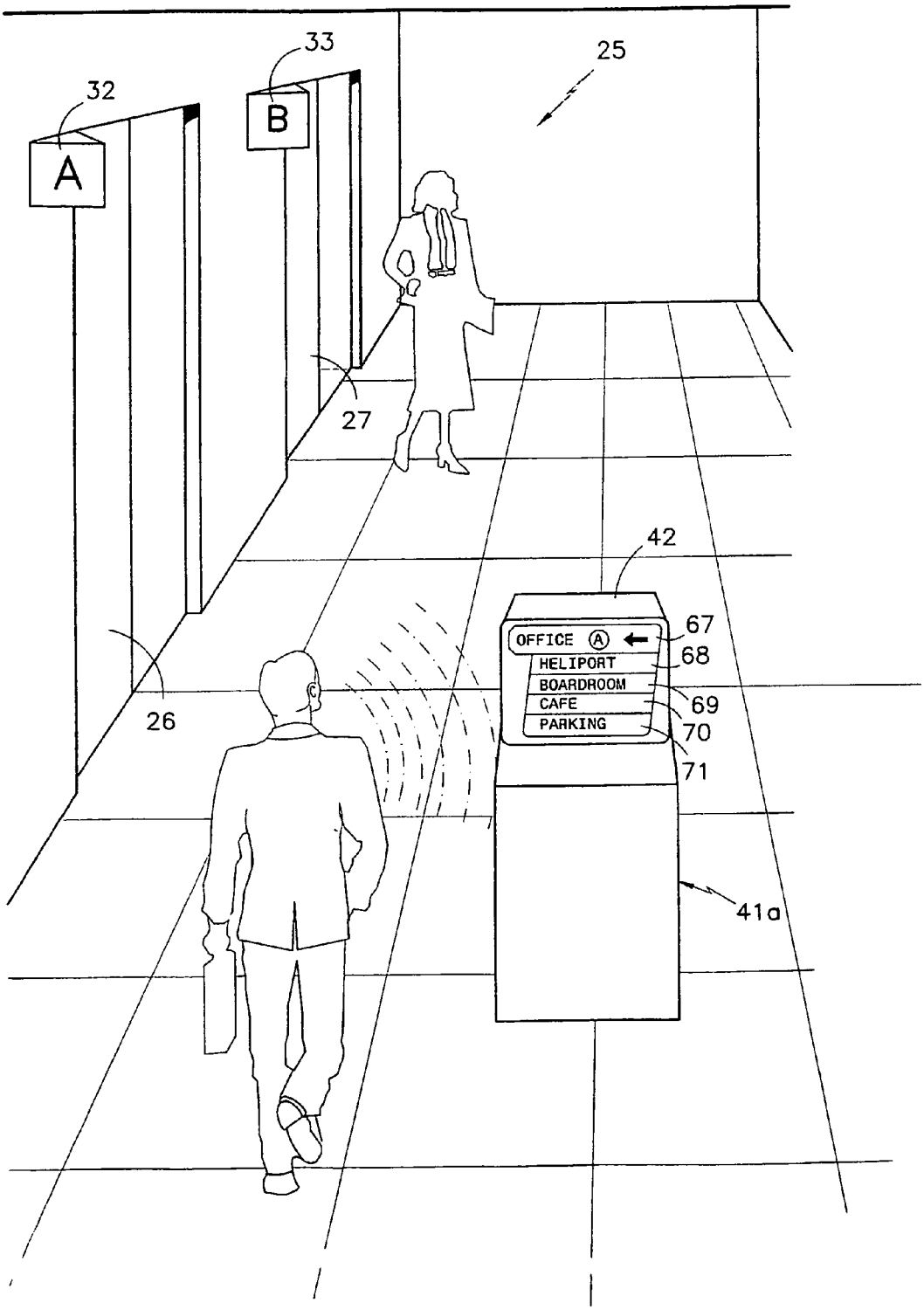
FIG. 8 is a simplified perspective view of an elevator lobby having a kiosk which senses the approach of a particular passenger to display a default (usual) floor and other options for that particular person, as illustrated in more detail in FIG. 9.

FIG. 8 illustrates a particular passenger, typically referred to as a VIP (for "very important person") approaching a kiosk 41*a* and signaling by electromagnetic radiation, such as from a smart card 66 (FIG. 10), the fact of his presence and his identity. The range of communication is kept small so that the kiosk will react to only a particular individual when he is close to the kiosk. This may be achieved by means of conventional radio frequency ID devices (RFID), such as is conventionally used for EZ-PASS®, in which the kiosk would interrogate the RFID on the passenger and the RFID would respond with the passenger identification information. Alternatively, the passenger could press a button to cause a transmission to the kiosk. Other ways of effecting the communication may be implemented, all of which is irrelevant to the invention. As seen in FIG. 8 when the kiosk recognizes the particular VIP, it will alter the touch screen to display, for example, a floor utilization button 67 indicating the VIP's office, the fact that elevator A is being assigned to him, and that elevator A is to the left. Other optional utilization floor buttons 68-71 may designate a heliport, a boardroom, a cafeteria, or a parking level. By pressing one of these buttons, the VIP may go to an alternative destination, rather than to his office. In such a case, the office button would shrink; to the size of the other buttons and the selected button would become outsized and provide room to indicate the elevator and the direction toward that elevator.

Figure 9:
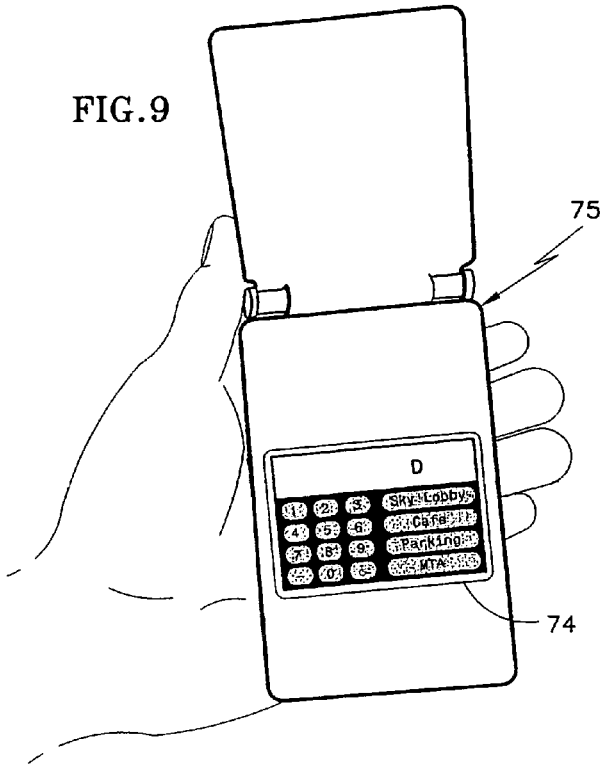
FIG. 9 is a perspective view of a hand-held elevator call device.

FIG. 9 illustrates that the programmable adaptable touch screens 74 described hereinbefore may be implemented in a hand-held device 75. The programming instructions for the touch screen must of course be communicated thereto in some wireless fashion, such as by means of electromagnetic radiation (RF or IR), as is illustrated in FIG. 10.

Figure 10:
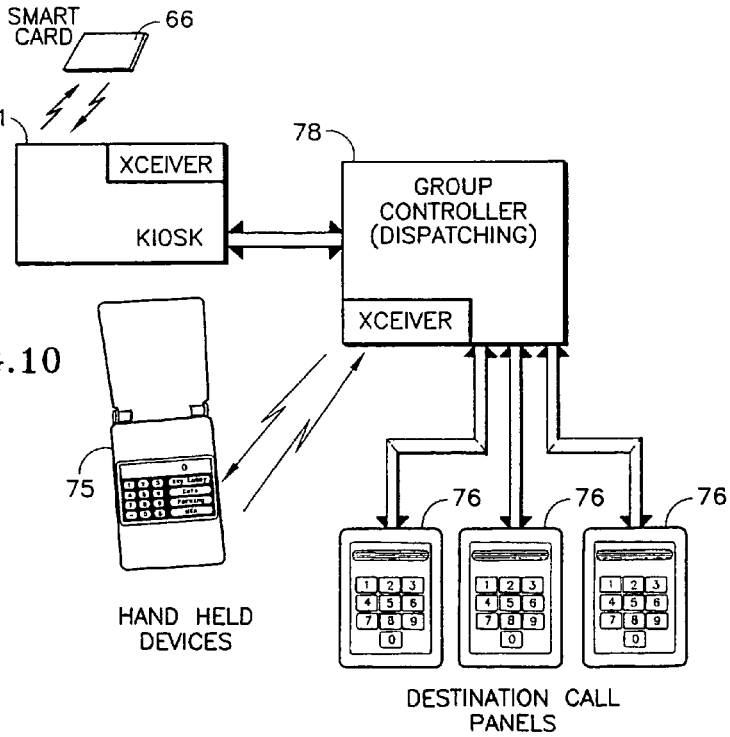
FIG. 10 is a simplified schematic block diagram of an elevator control system including destination call panels, card readers, hand-held devices, a kiosk, and smart card, all interrelated by a group controller that controls dispatching of the elevators, including morning rush hour up peak channeling, and adapting the touch screens to the circumstances.

A system which may implement the present invention is illustrated in FIG. 10. A group controller 78 will, either by monitoring the level of traffic or the time of day, determine a particular traffic mode in the elevator system. From this, the group controller 78 will program the touch screens in a variety of ways as has been described hereinbefore. The group controller will communicate touch screen programming information to a variety of devices, such as the kiosk 41, hand-held devices 75, and other destination call panels 76, which may for instance comprise touch screens mounted in hallways approaching the elevator lobby. Within each of the touch screens, depending on the displayed button which is pressed, the controller will enter a service call, which for up/down buttons only calls an elevator to a landing. In case of destination buttons (10-key, N-key or utilization), the passenger's desired floor will be communicated to the group controller, which will enter the destination call and acknowledge it by illuminating either a button or a display in an appropriate way, and in the case of instant elevator assignment, will indicate the elevator which is to respond to the call on the touch panel 42 of the kiosk 41, the hand-held device, or a destination call panel 76. In the case of hand-held devices 75, even though instant call assignment is not being made, the assigned elevator can be displayed on the touch screen 74.

With respect to the special display on the kiosk described with respect to FIG. 8, the communication between the smart card 66 and the kiosk 41*a* will cause a controller within the kiosk to reprogram the touch panel as described with respect to FIG. 8; on the other hand, the presence of a VIP indicated by communication from the smart card 66 could be received at the kiosk 41*a*, forwarded to the group controller 78, and the group controller 78 could communicate back through the kiosk 41*a* the correct programming for the touch screen 42.

In FIG. 10, the destination call panels 76 illustrate that touch screens in accordance with the invention need not have floor utilization buttons 50-53, if such is desired in any particular implementation of the present invention.

The invention claimed is:

1. An elevator hall call system comprising:

a programmable, adaptable interface between passengers and a group of elevators serving a plurality of floors of a building, the interface allowing a passenger to place a call for service from outside of the elevators, the interface comprising at least one programmable touch screen that alternatively displays at least one of at least two patterns and responds differently to portions of said patterns being touched by persons in dependence on the meaning of said patterns, said patterns having one portion that includes buttons which identify utilization of at least two of the floors of the building, said utilization selected from (a) functions and (b) tenants located on respective floors, and another portion that includes buttons selected from (c) ten key destination call buttons, (d) up hall call and down hall call buttons, and (e) N-key destination buttons including one button per selectable floor; and a controller that causes said at least one touch screen to display one or another of said at least two patterns in dependence on at least one circumstance related to said elevators, said at least one circumstance including at least the identity of a particular passenger in the vicinity of said at least one touch screen, said controller entering a service call in response to any one of said buttons being touched.

2. An elevator hall call system comprising:

a programmable, adaptable interface between passengers and a group of elevators serving a plurality of floors of a building, the interface allowing a passenger to place a call for service from outside of the elevators, the interface comprising at least one programmable touch screen that alternatively displays at least one of at least two patterns and responds differently to portions of said patterns being touched by persons in dependence on the meaning of said patterns, each of said patterns having one portion that includes buttons selected from (a) numerical destination call buttons and (b) up hall call and down hall call buttons, and another portion that includes buttons which identify utilization of at least two of the floors of the building, said utilization selected from (a) functions and (b) tenants located on respective floors; and a controller for programming said at least one touch screen to display one or another of said at least two patterns, said controller entering a service call in response to any one of said buttons being touched.

3. An elevator hall call system comprising:

a programmable, adaptable interface between passengers and a group of elevators serving a plurality of floors of a building, the interface allowing a passenger to place a call for service from outside of the elevators, the interface comprising at least one programmable touch screen that alternatively displays at least one of at least two patterns and responds differently to portions of said patterns being touched by persons in dependence on the meaning of the displayed one of said patterns; and a controller that causes said at least one touch screen to display one or another of said at least two patterns in dependence on at least one circumstance related to said elevators, said at least one circumstance including at least the identity of a particular passenger in the vicinity of said at least one touch screen, said controller entering a service call in response to any one of said buttons being touched.

4. A system according to claim 3 wherein said at least one circumstance includes elevator traffic volume or time of day.

5. A system according to claim 3 wherein said at least one circumstance includes a floor of the building where said interface is disposed.

* * * * *